United States Patent [19]

Nobutoki

[11] Patent Number: 4,975,666

[45] Date of Patent: Dec. 4, 1990

[54] POLARIZED ELECTROMAGNETIC RELAY

[75] Inventor: Kazuhiro Nobutoki, Matsuzaka, Japan

[73] Assignee: Matsushita Electric Works, Ltd., Japan

[21] Appl. No.: 493,443

[22] Filed: Mar. 14, 1990

[30] Foreign Application Priority Data

Mar. 28, 1989 [JP] Japan ..... 1-75817
Jul. 26, 1989 [JP] Japan ..... 1-195037

[51] Int. Cl.[5] ..... H01H 51/22

[52] U.S. Cl. ..... 335/78; 335/85; 335/128

[58] Field of Search ..... 335/78–85, 335/124, 128, 230

[56] References Cited

U.S. PATENT DOCUMENTS

| | | | |
|---|---|---|---|
| 2,960,583 | 11/1960 | Fisher et al. . | |
| 4,064,471 | 12/1977 | Schuessler et al. . | |
| 4,551,698 | 11/1985 | Aidn | 335/80 |
| 4,695,813 | 9/1987 | Nobutoki et al. . | |
| 4,703,293 | 10/1987 | Ono et al. | 335/80 |
| 4,734,668 | 3/1988 | Dittmann | 335/128 |
| 4,881,053 | 11/1989 | Tanaka et al. | 335/80 |
| 4,912,438 | 3/1990 | Youdo | 335/78 |

FOREIGN PATENT DOCUMENTS 2148377 9/1973 Fed. Rep. of Germany .

*Primary Examiner*—Leo P. Picard

*Assistant Examiner*—Lincoln Donovan

*Attorney, Agent, or Firm*—Stevens, Davis, Miller and Mosher

[57] ABSTRACT

A polarized electromagnetic relay is designed to have a minimum height as less as that of an electromagnet block constituting one major part of the relay. The relay includes a base which is formed to receive the electromagnet block and to have a set of fixed contacts. The electromagnet block includes a generally U-shaped yoke with a pair of opposed legs connected by a center core and at least one excitation coil wound around the center core. An armature block is mounted within the base together with the electromagnet block and comprises an elongated armature extending over the opposed pole legs and pivotally supported for movement between first and second positions about a pivot axis. The armature block carries a movable contact for contact selectively with one of the fixed contacts in response to the armature movement between the first and second positions. The armature is magnetically coupled to the pole legs by means of a permanent magnet such that the armature block responds to polarity change in the current energizing the excitation coil to move between the first and second positions. The permanent magnet is disposed in the bottom portion of the base within the plane of the pole legs. The armature block is disposed above the permanent magnet in such a manner that the armature block and the permanent are stacked within the height of the electromagnet block.

6 Claims, 6 Drawing Sheets

100C 62C
61C
69C
52C
50C
64C
69C
51C
89
88
83C
87C
70C
85C
80C
89
90C
26C
45C
18C
16C
42C
10
27
44C
40C
32C
41C
19C
30C
31C

POLARIZED ELECTROMAGNETIC RELAY

BACKGROUND OF THE INVENTION

1. Field of the Invention

The present invention is directed to a polarized electromagnetic relay, and more particularly to a polarized miniature electromagnetic relay with a reduced height.

2. Description of the prior art

Polarized electromagnetic relays have been widely utilized in the art. As disclosed in German Pat. No. 2148377, and U.S. Pat. Nos. 2,960,583, 4,064,471, and 4,695,813, typical prior art polarized electromagnetic relays are generally designed to comprise an electromagnet with a magnetic core and an excitation coil, an armature carrying a movable contact, and a permanent magnet for polarity responsive armature movement. In order to provide a compact arrangement for these three major parts of occupying relatively large spaces in the relay structure, i.e., the electromagnet, the armature, and the permanent magnet, the armature is mounted to extend along generally in parallel with an axis of the excitation coil of the electromagnet within the length of the electromagnet and is pivotally supported for contacting operations about a pivot axis which is perpendicular to the axis of the excitation coil. Also the permanent magnet is disposed between the armature and the electromagnet to magnetically couple them for the polarity responsive armature actuation. When the armature is required to have its pivot axis horizontally to meet with a particular contact arrangement demanded for the relay structure, the electromagnet, the armature and the permanent magnet are arranged to be vertically stacked, as seen in the above U.S. Patents. Consequently, the relay has to be made with an increased height as much as the added vertical dimensions of at least the electromagnet and the armature. In this respect, the prior relays fails to be miniaturized with respect to the height dimension.

Further, in the relay particularly of miniaturized ones, it is highly desired to electrically separate the electromagnet and the armature as much as possible within a limited space in order to give enough insulation distance between the excitation coil and a set of contacts provided on and adjacent to the armature. However, the prior art relays with vertically stacked electromagnet and the armature are found difficult to provide effective electrical insulation between the excitation coil of the electromagnet and the set of contacts on the side of the armature.

SUMMARY OF THE INVENTION

The above problems associated with prior relays have been eliminated in the present invention which provides a miniature polarized electromagnetic relay offering new and unique features. The relay in accordance with the present invention comprises a base provided with a set of fixed contacts and formed to mount an electromagnet block, an armature block and a permanent magnet. The electromagnet block includes a generally U-shaped yoke with a pair of opposed pole legs connected by a center core and at least one excitation coil wound around the center core, and is mounted in the base with the pole legs lying in the bottom portion of the base. The armature block includes an elongated armature extending generally in parallel with the center core to extend over the opposed pole legs and pivotally supported for movement between first and second positions about a pivot axis extending horizontally in generally perpendicular relation to the center core or an axis of the excitation coil. A movable contact is carried on the armature block for selective contact engagement with one of the fixed contacts in response to the armature movement about the pivot axis between the first and second positions. The permanent magnet is received within a plane of the pole legs to magnetically couple the pole legs to the armature such that the armature block responds to a given polarity of voltage applied to the excitation coil to move from the first position to the second position. The armature block is disposed vertically above the permanent magnet and in horizontally spaced relation to the excitation coil such that the armature block and the permanent magnet are vertically stacked within the height of the electromagnet block. Accordingly, the relay can have its overall height dimension reduced to as less as that of the electromagnet block.

It is therefore a primary object of the present invention to provide a polarized electromagnetic relay of which height dimension can be reduced to a minimum.

In a preferred embodiment, the interior of the base is divided horizontally into a coil compartment and a switch compartment by a partition projecting on the bottom of the base. The coil compartment is provided for receiving the electromagnet block except for the pole legs, while the switch compartment is for receiving the permanent magnet and the armature block and provided with the set of the fixed contacts. The electromagnet block includes a coil bobbin of an electrically insulating material which envelops the yoke except for the pole legs to provide an insulation sleeve around the connection between the center core and each of the pole legs. The insulation sleeves are positioned on the bottom of the base to be cooperative with the above partition for electrically isolating the coil compartment from the switch compartment, whereby effectively insulating the excitation coil from the movable spring on the armature as well as from the fixed contacts on the side of the switch compartment. With this result, the electromagnet block and the armature block can be closely packed to reduce a horizontal dimension of the relay along which the electromagnet and the armature are arranged, while assuring enough electrical insulation therebetween.

It is therefore another object of the present invention to provide a polarized electromagnetic relay in which the contacts provided on the side of the armature can be effectively insulated from the excitation coil of the electromagnet block by better utilization of the portions of the coil bobbin in cooperation with the partition formed on the bottom of the base, and in which the electromagnet block and the armature can be closely packed to reduce the horizontal dimension of the relay.

The permanent magnet in one embodiment of the present invention is in the form of an elongated magnet bar extending between the pole legs of the yoke along the armature in closely adjacent relation thereto. The permanent magnet bar is magnetized to have end poles of the same polarity at the longitudinal ends and have a center pole of the opposite polarity. The armature is placed immediately above the three pole magnet bar so as to be magnetized to the polarity which is same as the center pole but is opposite to that of the pole legs magnetized by the end poles of the magnet bar. In order to achieve an efficient magnetic flux path or circuit between thus magnetized armature and the pole legs of the yoke through the permanent magnet, the upper surface of the permanent magnet bar is inclined such that the portion of the armature is held in substantially parallel to the inclined surface of the permanent magnet when the armature is in either of the first or second position. Whereby it is possible to reduce leakage of magnetic flux emanating from the permanent magnet and extending through the portion of the armature required for keeping the armature in either of the first or second position, assuring an efficient magnetic circuit for stably holding the armature in position.

It is therefore a further object of the present invention to provide a polarized electromagnetic relay with an improved magnetic system.

In another version of the present invention, an elongated flux plate is utilized in combination with a two-pole permanent magnet. The flux plate extends between the pole legs of the yoke with the permanent magnet supported on the middle of the flux plate in order to magnetize the pole legs to the same polarity by the permanent magnet. The armature has its center placed adjacent to the permanent magnet so as to be magnetized thereby to the polarity opposite to the pole legs for effecting polarity responsive armature movement between the first and second positions. With the use of the flux plate bridging the pole legs of the yoke, it is possible to use the two-pole magnet of conventional type, which is therefore a still further object of the present invention.

The armature block is formed to have at least one pivot pin extending transversely to be rotatably journaled in the base and to have a common contact tab projecting for electrical contact with a common terminal lug provided on the base. The common contact tab extends integrally from the movable contact through a constricted strip which defines a torsion spring biasing the armature block toward a neutral position between the first and second positions. Thus, the torsion spring can be formed by better utilization of the movable contact which is to be electrically connected to the common terminal on the side of the base in order to assist the changeover of the armature movement. Further, with the provision of separately forming the pivot pin from the torsion spring, the armature block can be stably supported on the base for precise pivotal movement about the pivot pin without relying upon the torsion spring for the pivotal support of the armature block.

It is therefore a further object of the present invention to provide a polarized electromagnet relay in which the armature block can be stably supported for reliable pivotal movement, while the armature block can be spring biased for optimum response sensitivity by a torsion spring formed as an integral member of the movable spring.

These and the other objects and advantageous features will become more apparent from the following description of the embodiments of the present invention when taken in conjunction with the attached drawings.

DETAILED DESCRIPTION OF THE EMBODIMENTS

First embodiment <FIGS. 1 to 7>

Figure 1:
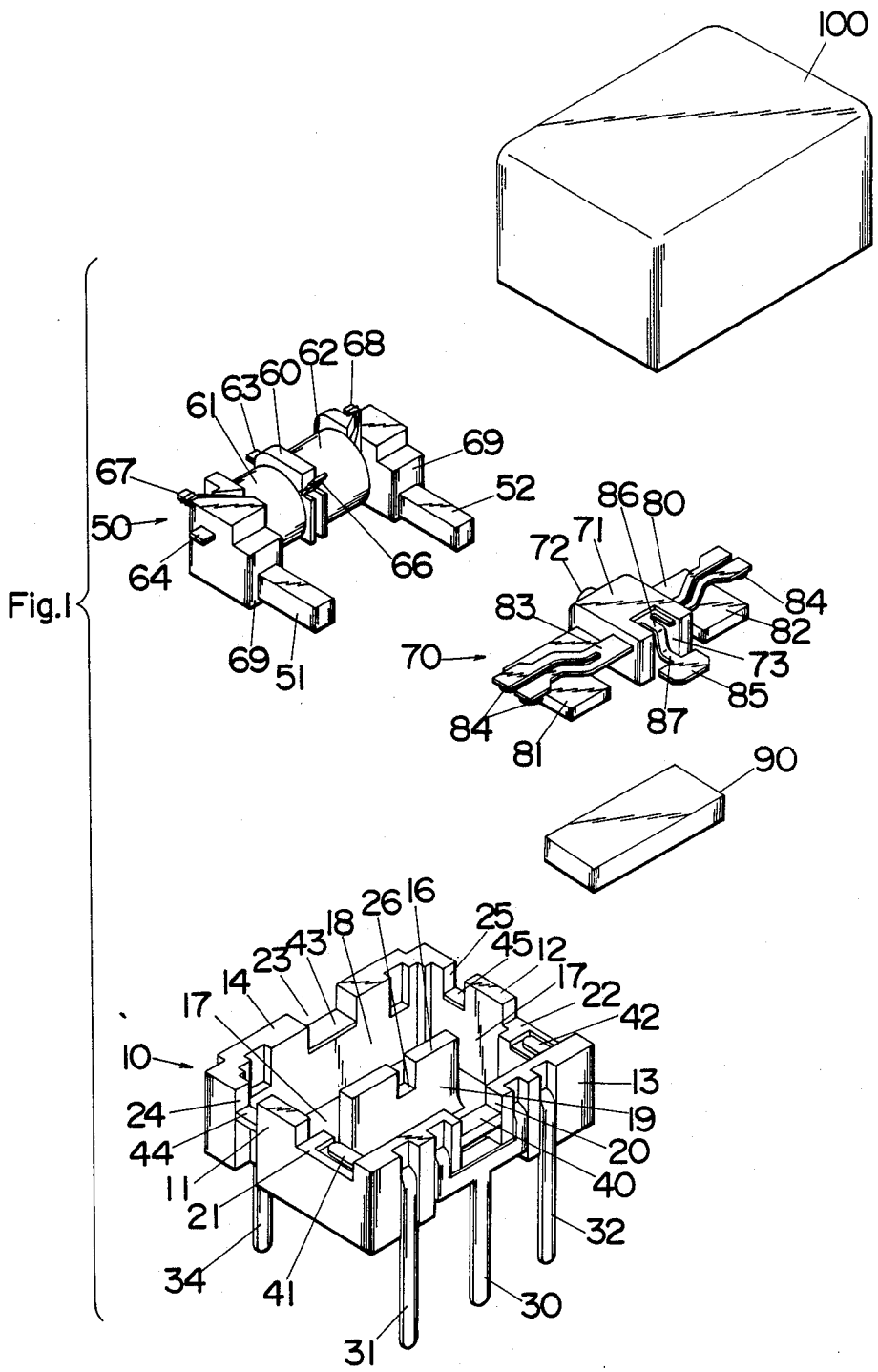
FIG. 1 is an exploded perspective view of a polarized electromagnetic relay in accordance with a first embodiment of the present invention.

Referring now to FIG. 1, a polarized electromagnetic relay in accordance with a first embodiment of the present invention is shown to be of bistable type having a single-pole double-through contact arrangement. The relay comprises a top-opened rectangular base 10 mounting therein an electromagnet block 50, an armature block 70, and a permanent magnet 90. These relay components are assembled into the base 10 from the above. The base 10 is made of electrically insulating plastic material to have a pair of opposed end walls 11, 12 and a pair of opposed side walls 3, 14. A partition 16 is formed on a bottom of the base 10 to roughly divide the interior of the base 10 laterally into a coil space 18 and a switch space 19, respectively for receiving the electromagnet block 50 and a stack of the armature block 70 and the permanent magnet 90.

Projecting downwardly of the base 10 are a set of molded-in terminal lugs composed of a common terminal 30, a pair of first and second contact terminal 31 and 32, a common coil terminal 33, and a pair of first and second coil terminals 34 and 35. The common terminal 30 has its upper end bent to form a common fixed contact 40 for constant electrical connection with a movable contact 83 of the armature block 70. The common contact 40 is received in a center notch 20 at the upper center of the side wall 13 forming one side wall of the switch space 19. The upper ends of the first and second terminals 31 and 32 are bent respectively to form first and second fixed contacts 41 and 42 which extend respectively into end notches 21 and 22 formed in the upper ends of the end walls 11 and 12 at portions on the opposite ends of the switch space 19. The common coil terminal 33 has its upper end bent and received in a center notch 23 in the other side wall 14 to define thereat a common coil contact 43. Likewise, the upper ends of the first and second coil terminals 34 and 35 are bent and extend respectively into end notches 24 and 25 in the upper ends of the end walls 11 and 12 at portions on the opposite ends of the coil compartment 18, so as to define thereat first and second coil contacts 44 and 45, respectively.

The electromagnet block 50 comprises a generally U-shaped yoke with first and second pole legs 51 and 52 connected by a center core 53, and a series connected pair of first and second excitation coils 61 and 62 wound around a coil bobbin 60 into which the center core 53 extends. Integrally molded into the coil bobbin 60 are a set of coil leads including a common coil lead 63 wired to the connection between the first and second excitation coils 61 and 62, a first contact lead 64 wired to the other end of the first excitation coil 61, and a second contact lead 65 wired to the other end of the second excitation coil 62. For wiring to the excitation coils 61 and 62, the coil leads 63 to 65 are formed to have integral segments 66 to 68 which project outwardly of the coil bobbin 60 to be directly connected to the corresponding coil ends. These coil leads 63 to 65 are engaged respectively with the corresponding coil contacts 43 to 45 on the base 40 for constant electrical interconnection therebetween when the electromagnet block 50 is assembled into the coil compartment 18 of the base 10. The coil bobbin 60 is integrally formed at its ends respectively with insulation sleeves 69 which envelop the connections between the center core 53 and the individual the pole legs 51 and 52. The electromagnet block 50 thus formed is mounted within the coil space 18 of the base 10 With the pole legs 51 and 52 extending horizontally from the bottom of the coil space 18 into the bottom of the switch space 19. At this condition, the insulation sleeves 69 are fitted respectively into gaps 17 left on the opposite ends of the partition 16 so as to form with the partition 16 a continuous insulation wall separating the coil space 18 from the switch space 19 in an optimum manner to provide an effective electrical insulation of the contacts 40 to 43 and 83 on the side of the switch compartment 19 from the coils 61 and 62. Consequently, the electromagnet block 50 can be held close to the armature block 70 for miniaturization of the relay in the width dimension thereof, while assuring enough electrical insulation between the contacts and the excitation coils of the electromagnet block 50.

Figure 2:
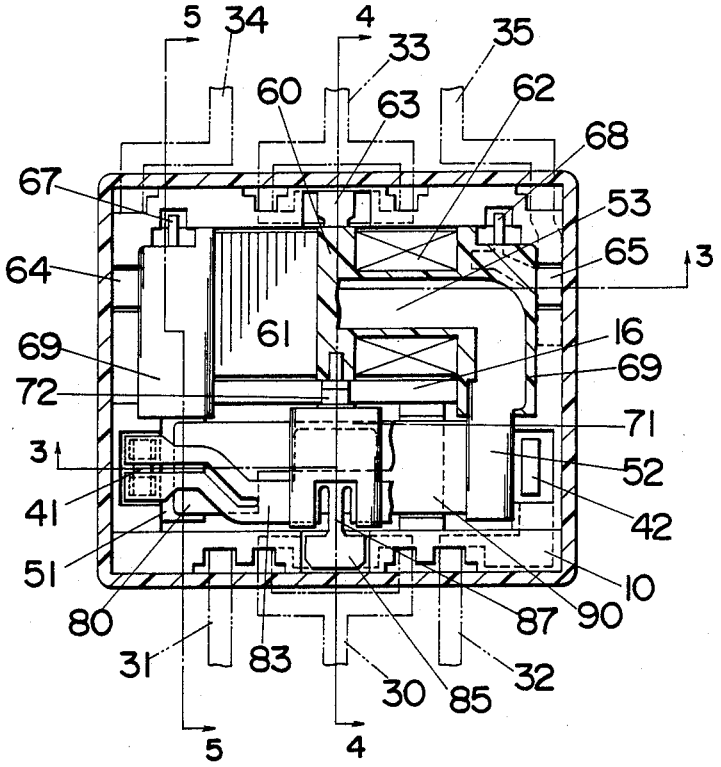
FIG. 2 is a top view partly in section of the above relay with a set of terminal lugs shown in a horizontally extended form.
Figure 4:
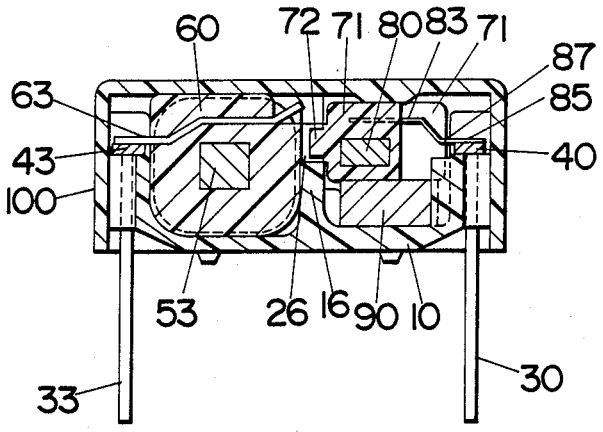
FIG. 4 is a sectional view taken along line 4—4 of FIG. 2.

The armature block 70 comprises a center body 71 carrying an elongated armature 80 together with the movable contact 83. The center body 71 is made of electrically insulating plastic material into which the center portions of the armature 80 and the movable contact 83 are molded. The armature 80 is shaped from a magnetic material into an elongated flat plate defining first and second ends 81 and 82 at the longitudinal ends. The movable contact 83 is also elongated to have contact tips 84 at the bifurcated ends for selective contacting engagement with the first and second fixed contacts 41 and 42 on the base 10. The movable contact 83 is given spring characteristic to develop suitable contact pressure between the contact tips 84 and the corresponding fixed contacts 41 and 42 at the contact closing condition. Extending laterally from the center of the movable contact 83 is a common contact tab 85 for constant electrical and mechanical connections to the common contact 40 on the base 10 leading to the common terminal lug 30. The center body 71 is formed with a pivot pin 72 which projects transversely on the side opposite to the contact tab 85 and is rotatably journaled in a bearing slot 26 formed in the upper end of the partition 16. Thus, the armature block 70 is received in the upper portion of the switch compartment 19 with the pivot pin 72 journaled in the bearing slot 26 and with the common contact tab 85 welded or soldered on the common contact 43 in the center notch 20. The common contact tab 85 is integrally connected to the center of the movable contact 83 through a constricted strip 86. The strip 86 is bent in a recess 73 of the center body 71 to form a pivot arm 87 which is, as shown in FIGS. 2 and 4, aligned with the pivot pin 72 and cooperative therewith to define a pivot axis about which the armature block 70 pivots between a first position of making the movable contact 83 into contact with the first fixed contact 41 and a second position of making the same into contact with the second fixed contact 42. It is noted at this time that the pivot arm 87 acts as a torsion spring biasing the armature block 70 towards the intermediate or neutral position between the first and second positions in order to assist the changeover of the armature block 70 in response to the selective energization of the excitation coils 61 and 62.

Figure 3:
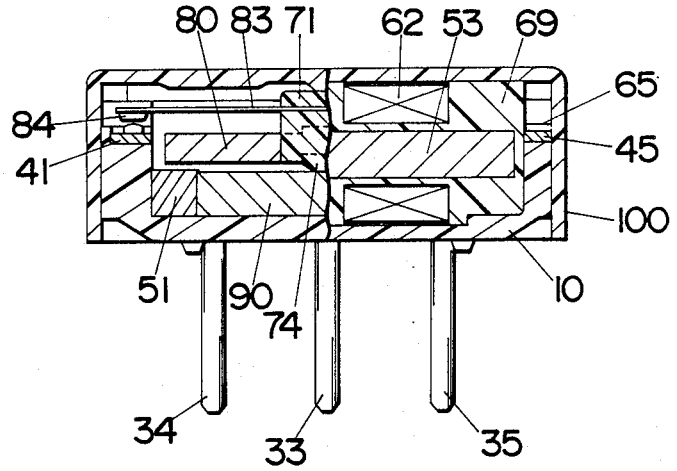
FIG. 3 is a view taken along line 3—3 of FIG. 2 with an armature shown in a neutral position between first and second contact operating positions.
Figure 6:
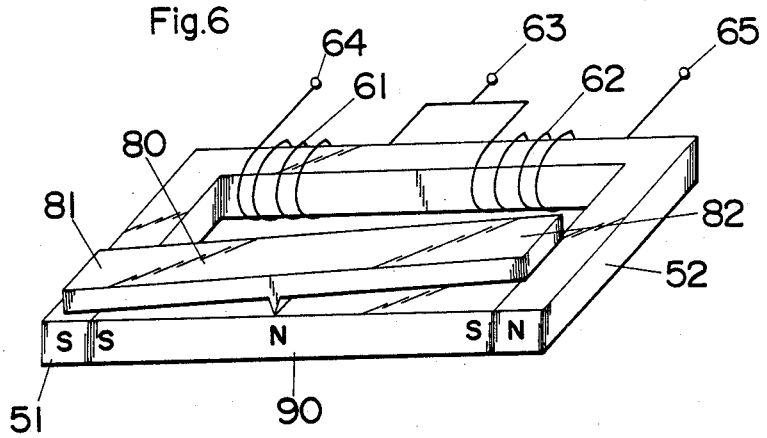
FIG. 6 is a schematic view illustrating a magnetic system of the relay.

The permanent magnet 90 is disposed in the bottom portion of the switch compartment 19 in a vertically stacked relation to the armature block 70, as shown in FIGS. 3 and 4, to extend between the first and second pole legs 51 and 52 within a horizontal plane including the pole legs. The permanent magnet 90 is an elongated three-pole magnet bar which is magnetized to have, in this instance, a N-pole at the center and S-poles at the longitudinal ends so as to magnetize the pole legs 51 and 52 to the same polarity, i.e., S-poles in the illustrated embodiment, as best shown in FIG. 6. The armature block 70 is placed immediately above the permanent magnet 70 with a pointed projection 74 on the bottom of the center body 71 resting upon the center of the permanent magnet 90 so that the armature 80 extends along the permanent magnet 90 in closely adjacent relation thereto and is magnetized to be of N-pole.

In operation, when the electromagnet block 50 is magnetized by selective energization of the excitation coil 61 or 62 to have S-pole at the first pole leg 51, the armature 80 pivots to the first position where the first end 81 is attracted to the first pole leg 51, as shown in FIG. 6, thereby closing the movable contact 83 to the first fixed contact 41. The armature 80 is stable at this first position until the electromagnet block 50 is magnetized to the opposite polarity by the existence of a magnetic flux of the permanent magnet 90 circulating from the center or N-pole of the permanent magnet 90 through the end half portion of the armature 80, the first pole leg 51 and back to the corresponding end or S-pole of the permanent magnet 90. The changeover of the armature 80 from the first position to the second position is made by the reverse energization of the excitation coil 62 or 61 to have the S-pole at the second pole leg 52. The armature 80 is also kept stable at the second position until the electromagnet is again energized to have the S-pole at the first pole leg 51.

Figure 5:
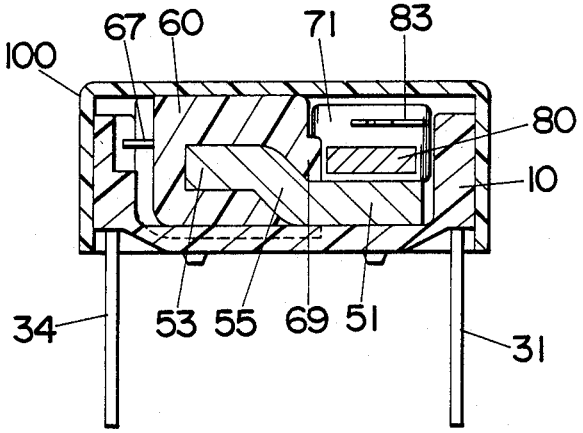
FIG. 5 is a sectional view taken along line 5—5 of FIG. 2.

As best seen in FIGS. 3 to 5, the armature block 70 and the permanent magnet 90 are vertically stacked in the switch compartment 19 within the height of the electromagnet block 50 such that the relay can have its overall height reduced to as less as the height of the electromagnet block 50. It is noted in this connection that, as seen in FIG. 5, the first and second pole legs 51 and 52 extend from the center core 53 respectively through inclined segments 55 so as to be offset downwardly from the center core 53, thereby providing sufficient space above the pole legs 51 and 52 for receiving the armature block 70 within the height of the electromagnet block 50.

Figure 7:
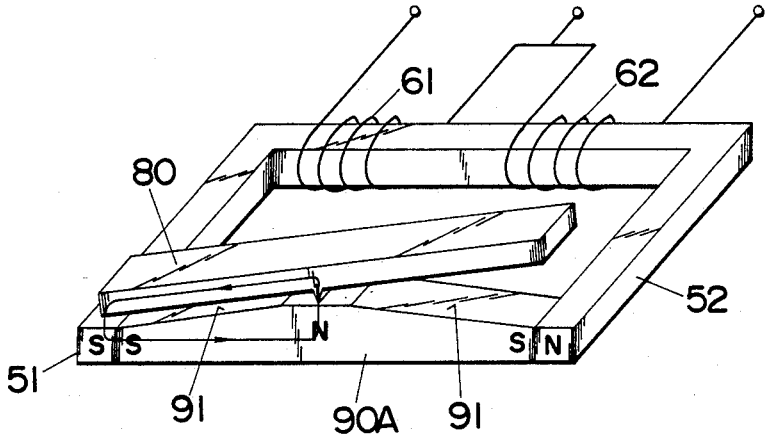
FIG. 7 is a perspective view illustrating a magnetic system with a modified permanent magnet which may be employed in the above relay.

In order to provide an improved magnetic circuit for actuation of the armature 80, it is effective to employ an alternative permanent magnet 90A which, as shown in FIG. 7, is formed to have oppositely inclined surfaces 91 extending downwardly and outwardly from the center to the longitudinal ends, such that each of the inclined surfaces 91 lies in substantially parallel with the corresponding end half portion of the armature 80 when the armature so is in either of the first or second position, whereby reducing magnetic flux leakage and keeping the armature 80 stably in either of the first or second position. A cover 100 of electrically insulating material is fitted over the base 10 to hermetically seal the relay components therebetween.

Figure 8:
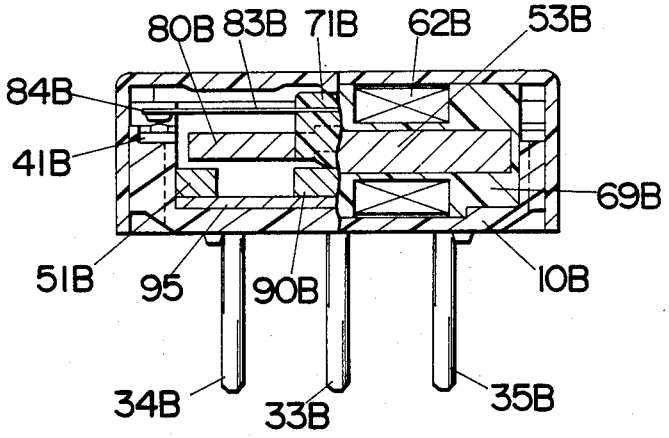
FIG. 8 is a sectional view similar to FIG. 3 but illustrating a modification of the above first embodiment.

FIG. 8 illustrates a modification of the above embodiment which is characterized to use a permanent magnet 90B in combination with a flux plate 95. The other structure and operation are identical to that of the above embodiment. Therefore, like parts are designated by the same reference numerals plus a suffix letter of "B". The permanent magnet 90B is of a conventional two-pole magnet piece and is disposed between an armature 80B and a flux plate 95 to magnetize the armature 80B to N-pole and the flux plate 95 to S-pole. The flux plate 95 extends between first and second pole legs 51B and 52B of an electromagnet block 50B to magnetize the pole legs to the same polarity, i.e., S-pole as the flux plate 95. The operation is identical to that of the first embodiment.

Figure 9:
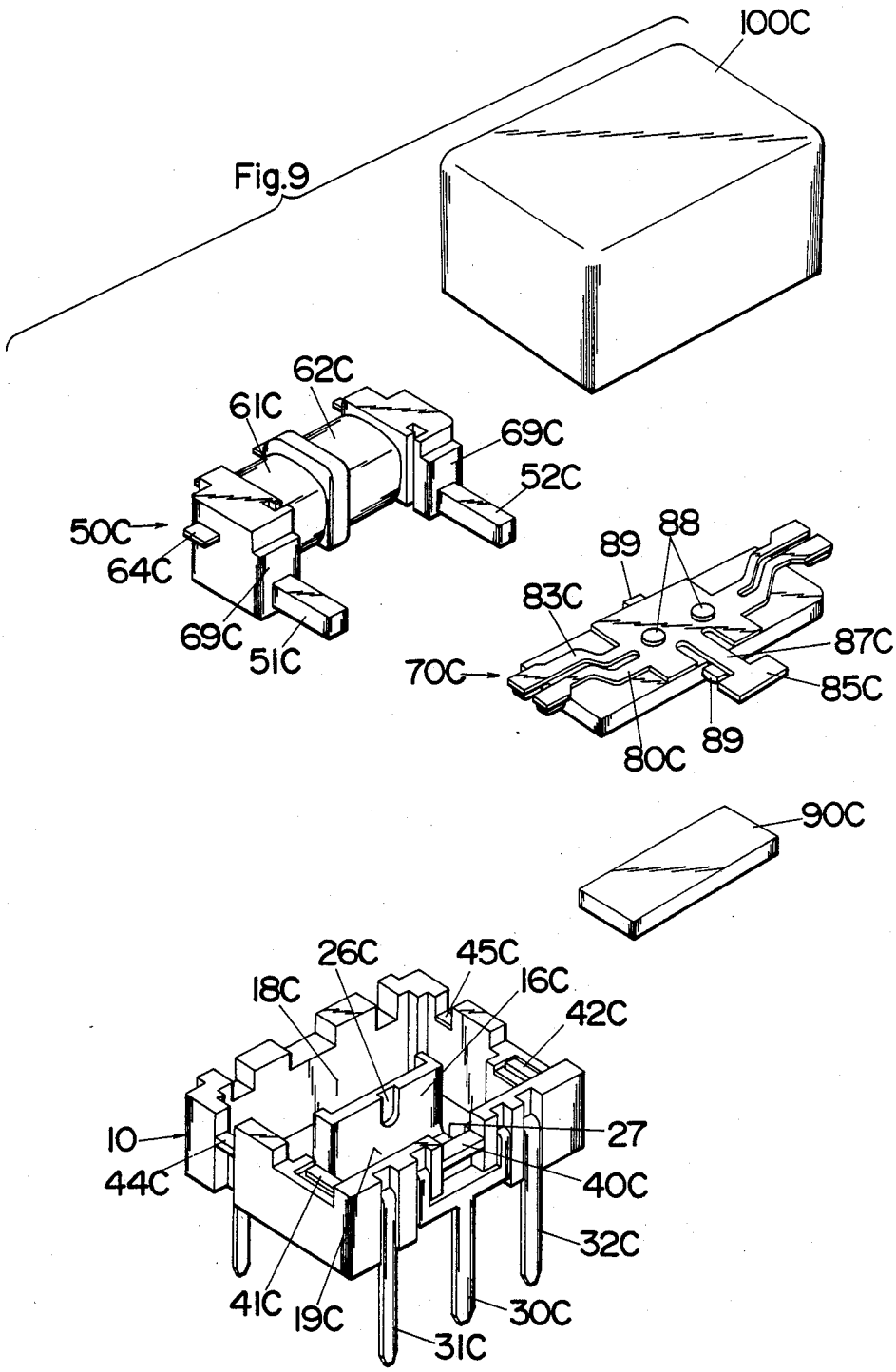
FIG. 9 is an exploded perspective view illustrating a polarized electromagnetic relay in accordance with a second embodiment of the present invention.
Figure 10:
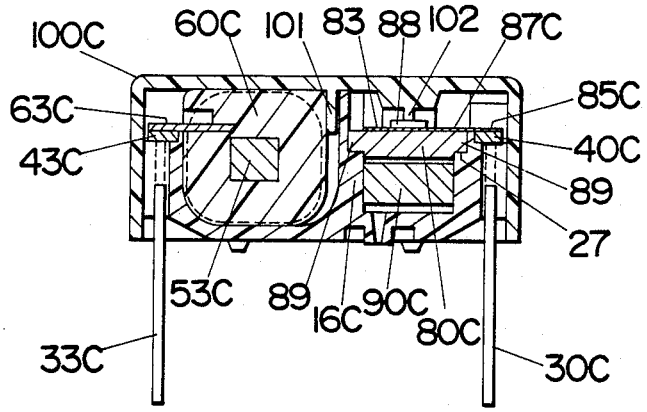
FIG. 10 is a sectional view similar to FIG. 4 but illustrating the relay of FIG. 9.

Second Embodiment <FIGS. 9 and 10>

A relay of the second embodiment is identical in structure and operation to the first embodiment except for a detailed configuration of an armature block. Like parts are designated by like numerals with a suffix letter of "C". The armature block 70C comprises an elongated armature 80C of flat configuration and a movable contact 83C secured at its center to the armature 80C by means of rivets 88. Projecting integrally from the lateral center of the armature 80C are an aligned pair of pivot pins 89. One of the pivot pins 89 is rotatably journaled in a bearing slot 26C at the upper end of a partition 16C, while the other pivot pin 89 is likewise journaled in a bearing slot 27 formed in the upper end of the side wall 13C of the base 10C, such that the armature block 70C is rotatably supported in the upper portion of a switch compartment 19C for pivotal movement about an horizontal axis defined by the pivot pins 89. Likewise in the first embodiment, the movable contact 83C is also formed with a common contact tab 85C projecting laterally for electrical as well as mechanical connection to a common contact 40C On the base 10C leading to a common contact terminal 30C. The common contact tab 85C is integrally connected to the movable contact 83C by means of a constricted strip 87C which defines itself a torsion spring for biasing the armature 80C to a neutral position between the first and second positions. As seen in FIGS. 9 and 10, the strip or torsion spring 87C is offset vertically from the pivot pins 89 so as not to form the pivot axis. With this arrangement of rotatably supporting the armature 80C by a pair of the pivot pins 89 without relying on the torsion spring 87C as opposed to the first embodiment, it is easy to stably support the armature soC and to adjust the spring characteristic of the torsion spring 87C independently of the requirement of supporting the armature 80C. In this embodiment, the armature 80C is supported immediately above a permanent magnet 90C in out of contact relation thereto but is held close enough to the permanent magnet 90C to be magnetically coupled thereto. A cover 100C of insulating plastic material is fitted over the base 10C to hermetically seal the relay. As shown in FIG. 10, the cover 100C is formed on its upper bottom with a depending rib 101 which overlaps the partition 16C to effectively insulate the electromagnet block 50C from the contacts provided on the side of the armature block 70C. Also extending from the upper bottom of the cober 100C is a retainer rib 102 which abuts against the center of the armature block 70C to assist holding the armature 80C in position for reliable pivotal movement about the pivot axis.

What is claimed is:

1. A polarized electromagnetic relay comprising:

a base provided with a set of fixed contacts;

an electromagnet block comprising a generally U-shaped yoke with a pair of opposed pole legs connected by a center core and excitation coil means wound around said center core, said electromagnet block mounted within said base with said pole legs lying in the bottom portion of said base;

an armature block having an elongated armature bridging over said opposed pole legs and pivotally supported for movement between first and second positions about a pivot axis extending horizontally in a generally perpendicular relation to said center core, said armature block carrying a movable contact for contacting engagement selectively with one of said fixed contacts in response to the movement of said armature between said first and second positions;

a permanent magnet magnetically coupling said armature to said pole legs such that said armature block responds to a given polarity of voltage applied to said excitation coil means to move from said first position to said second position, said permanent magnet mounted in the bottom of said base so as to be received within a plane of said pole legs;

said armature block disposed above said permanent magnet such that said armature block and the permanent magnet are stacked within the height of said electromagnet block.

2. A polarized electromagnetic relay as set forth in claim 1, wherein the interior of said base is divided horizontally into a coil compartment and a switch compartment by a partition on the bottom of said base, said coil compartment receiving said electromagnet block except for said pole legs, said switch compartment receiving said permanent magnet together with said armature block and provided with said fixed contacts;

said electromagnet block has a coil bobbin of an electrically insulating material which covers said yoke except said pole legs to provide an insulation sleeve around the connection between said center core of said yoke and each of said pole legs;

said insulation sleeves positioned to be cooperative with said partition to electrically isolate said coil compartment from said switch compartment.

3. A polarized electromagnetic relay as set forth in claim 1, wherein said permanent magnet is an elongated magnet bar extending between said pole legs along said armature in closely adjacent relation thereto;

said permanent magnet magnetized to have end poles of the same polarity at the longitudinal ends and have a center pole of the opposite polarity at a portion intermediate said longitudinal ends such that said pole legs are magnetized to the same polarity as said end poles while the armature is magnetized to the same polarity as said center pole.

4. A polarized electromagnetic relay as set forth in claim 3, wherein the upper surface of said permanent magnet confronting said armature is inclined such that the inclined armature surface is in substantially parallel relation to a corresponding portion of said armature when said armature is in either of said first or second position.

5. A polarized electromagnetic relay as set forth in claim 1, wherein said opposed pole legs are bridged by a flux plate extending substantially in parallel with said armature, and said permanent magnet held on said flux plate in an adjacent relation to a center portion of said armature so as to magnetize said flux plate and said armature to opposite polarity, thereby magnetizing said pole legs to the polarity opposite to said armature.

6. A polarized electromagnetic relay as set forth in claim 1, wherein said armature block including a pivot pin which is rotatably journaled in said base to define said pivot axis and including a common contact tab projecting for electrical contact with a common terminal provided on said base;

said common contact tab extending integrally from said movable contact through a constricted strip which define a torsion spring biasing the armature block toward a neutral position between said first and second positions.

* * * * *